US010711507B2

(12) United States Patent
Hsu

(10) Patent No.: US 10,711,507 B2
(45) Date of Patent: Jul. 14, 2020

(54) INTELLIGENT CHAIR STRUCTURE

(71) Applicant: Hung-Hsien Hsu, Meishan Township, Chiayi County (TW)

(72) Inventor: Hung-Hsien Hsu, Meishan Township, Chiayi County (TW)

( * ) Notice: Subject to any disclaimer, the term of this patent is extended or adjusted under 35 U.S.C. 154(b) by 210 days.

(21) Appl. No.: 16/008,291

(22) Filed: Jun. 14, 2018

(65) Prior Publication Data

US 2019/0383085 A1 Dec. 19, 2019

(51) Int. Cl.

| | |
|---|---|
| ***F25D 11/02*** | (2006.01) |
| ***A47C 7/62*** | (2006.01) |
| ***B65D 81/38*** | (2006.01) |
| ***E05G 1/08*** | (2006.01) |
| ***A47C 11/00*** | (2006.01) |
| ***E05B 65/44*** | (2006.01) |
| ***E05B 65/52*** | (2006.01) |
| *G07C 9/00* | (2020.01) |
| *E05B 47/00* | (2006.01) |

(52) U.S. Cl.

CPC ..... *E05G 1/08* (2013.01); *A47C 7/626* (2018.08); *A47C 11/00* (2013.01); *B65D 81/3825* (2013.01); *E05B 65/44* (2013.01); *E05B 65/52* (2013.01); *F25D 11/02* (2013.01); *E05B 47/0001* (2013.01); *E05G 2700/02* (2013.01); *G07C 9/00912* (2013.01)

(58) Field of Classification Search

CPC ..... F25D 11/02; B65D 81/3825; A47C 7/626; A47C 7/628; A47C 7/622

See application file for complete search history.

(56) References Cited

U.S. PATENT DOCUMENTS

| | | | | |
|---|---|---|---|---|
| 5,667,115 | A * | 9/1997 | Verhaeg | B60R 7/043 224/275 |
| 5,902,009 | A * | 5/1999 | Singh | B60N 2/90 297/188.1 |
| 6,264,216 | B1 * | 7/2001 | Wilson | B62B 1/00 280/30 |
| 6,644,523 | B1 * | 11/2003 | Salas | B60R 7/043 224/275 |
| 9,462,796 | B1 * | 10/2016 | Ellis | A01K 97/22 |

(Continued)

FOREIGN PATENT DOCUMENTS

CA 2139787 A1 * 1/1995

*Primary Examiner* — Timothy J Brindley

(74) *Attorney, Agent, or Firm* — Alan D. Kamrath; Mayer & Williams PC

(57) ABSTRACT

An intelligent chair structure contains: a function chair, a central control unit, three electronic locks, and a monitoring module. The function chair includes a base having first, second, and third accommodation chambers, wherein each accommodation chamber has a side holder, a rotatable lid, a refrigerator, a heat insulation apparatus, and a room temperature apparatus. The function chair further includes a power switch and a radiating cover. The central control unit is interconnected with an internet and includes an application (APP). Each of the three electronic locks includes a movable locking knob and a controlling module interconnected with the central control unit. The monitoring module is arranged on a predetermined position of the function chair and includes a video device interconnected with the central control unit and controlled by the APP of the central control unit.

5 Claims, 4 Drawing Sheets

(56) References Cited

U.S. PATENT DOCUMENTS

| | | | | |
|---|---|---|---|---|
| 10,232,788 | B1 * | 3/2019 | Hagedorn | B60N 2/02 |
| 2002/0005649 | A1 * | 1/2002 | Hofmann | B60R 7/043 296/37.15 |
| 2006/0261654 | A1 * | 11/2006 | Stallman | A47C 15/004 297/310 |
| 2006/0279052 | A1 * | 12/2006 | Marmah | A47C 1/14 280/47.26 |
| 2016/0000228 | A1 * | 1/2016 | Restrepo | A47C 7/62 297/188.1 |
| 2016/0200258 | A1 * | 7/2016 | Chawlk | B60R 7/043 296/37.14 |
| 2017/0105533 | A1 * | 4/2017 | Becker | F25D 3/08 |
| 2017/0245486 | A1 * | 8/2017 | Larson | A01K 97/10 |
| 2017/0349356 | A1 * | 12/2017 | Dudi | B65D 81/3825 |
| 2019/0285329 | A1 * | 9/2019 | Kehr | F25D 3/08 |
| 2019/0300266 | A1 * | 10/2019 | Bramwell | A61J 1/165 |

* cited by examiner

INTELLIGENT CHAIR STRUCTURE

BACKGROUND OF THE INVENTION

Field of the Invention

The present invention relates to an intelligent chair structure in which a rotatable lid of each accommodation chamber is opened or closed relative to each accommodation chamber by using each electronic lock so that user accommodates objects into each accommodation chamber of a function chair after opening or closing each accommodation chamber to obtain anti-theft; the function chair has instant monitoring in a scene by recording visual images or taking pictures and is remotely controlled by the user.

Description of the Prior Art

Social security events, such as robbery and theft, happen increasingly in recent years. To avoid the theft, a storage box having a lock is applied widely so as to achieve accommodation safety. The lock is a combination lock which is broken easily by thief with a hand tool. Furthermore, the lock cannot make instant warning to stop the thief, so the thief steals objects easily.

The present invention has arisen to mitigate and/or obviate the afore-described disadvantages.

SUMMARY OF THE INVENTION

The primary objective of the present invention is to provide an intelligent chair structure in which a rotatable lid of each accommodation chamber is opened or closed relative to each accommodation chamber by using each electronic lock so that user accommodates objects into each accommodation chamber of a function chair after opening or closing ach accommodation chamber, thus obtaining anti-theft.

Another objective of the present invention is to provide an intelligent chair structure in which the function chair has instant monitoring in a scene by recording visual images or taking pictures and is remotely controlled by the user.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
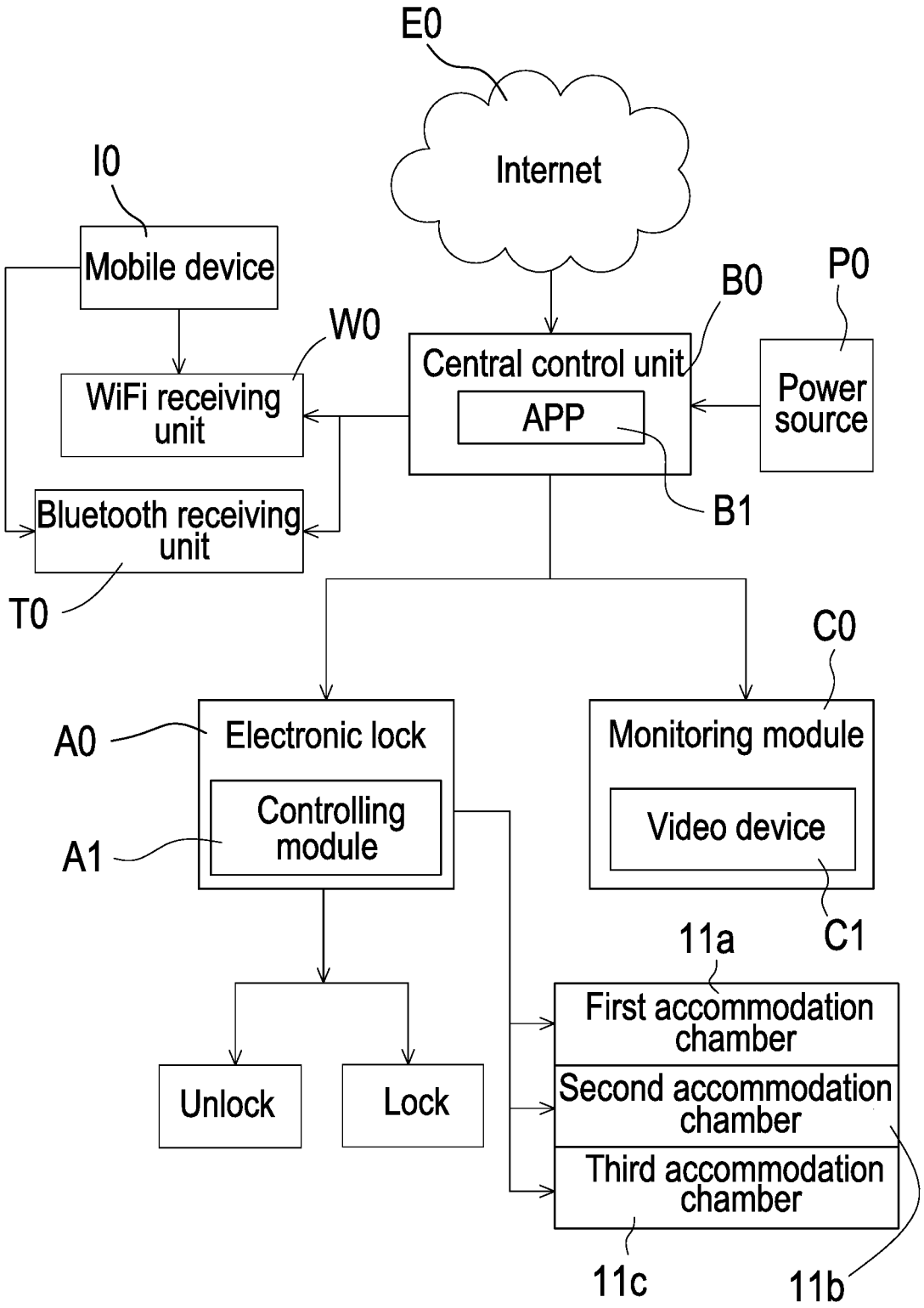
FIG. 1 is a block diagram of an intelligent chair structure according to a preferred embodiment of the present invention.
Figure 2:
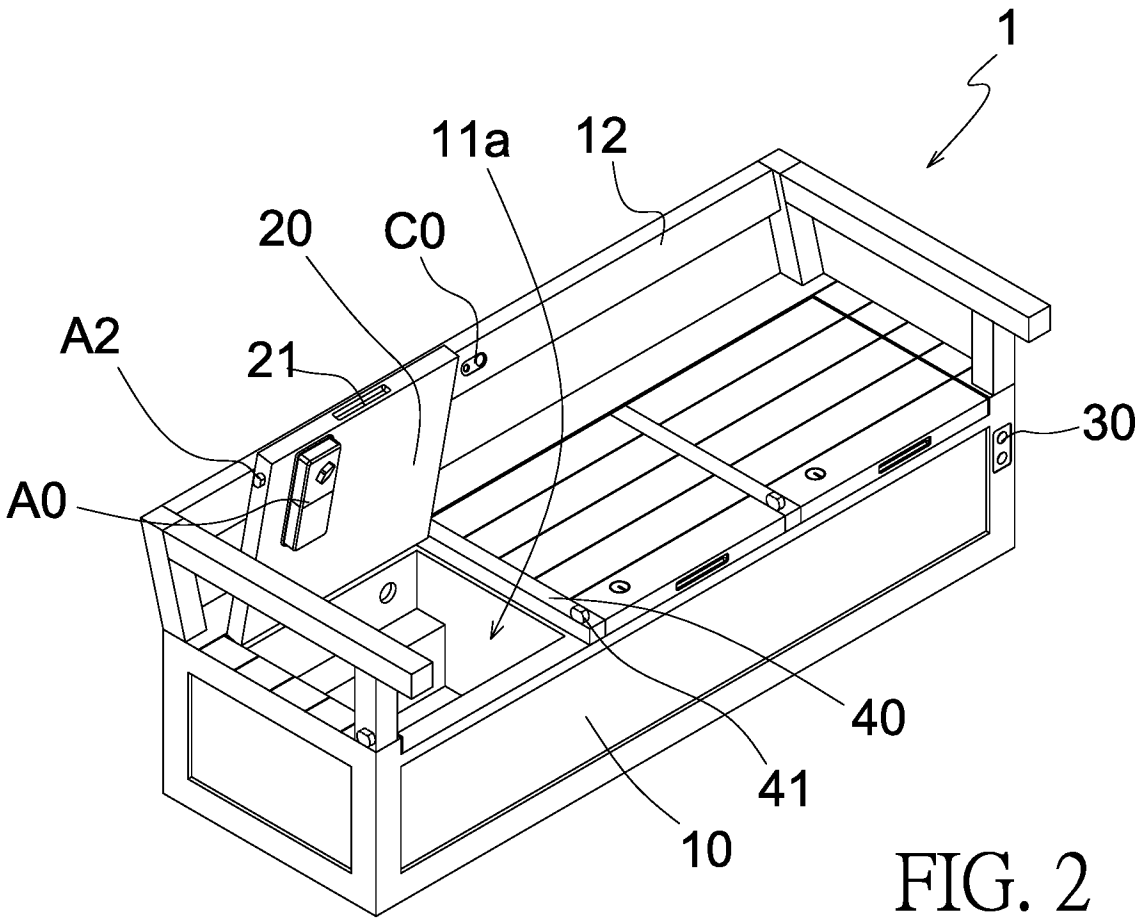
FIG. 2 is a perspective view showing the assembly of the intelligent chair structure according to the preferred embodiment of the present invention.
Figure 3:
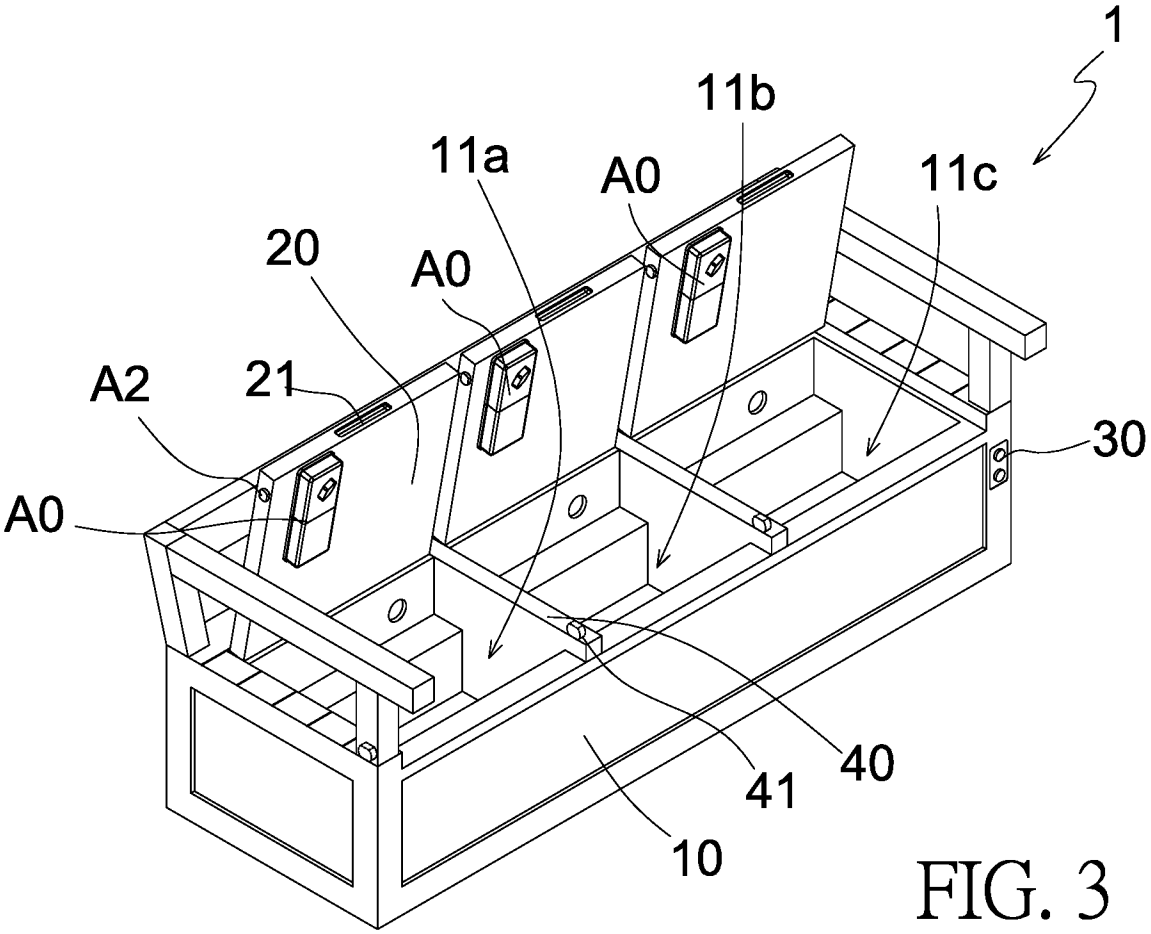
FIG. 3 is a perspective view showing the operation of a rotatable lid of the intelligent chair structure according to the preferred embodiment of the present invention.
Figure 4:
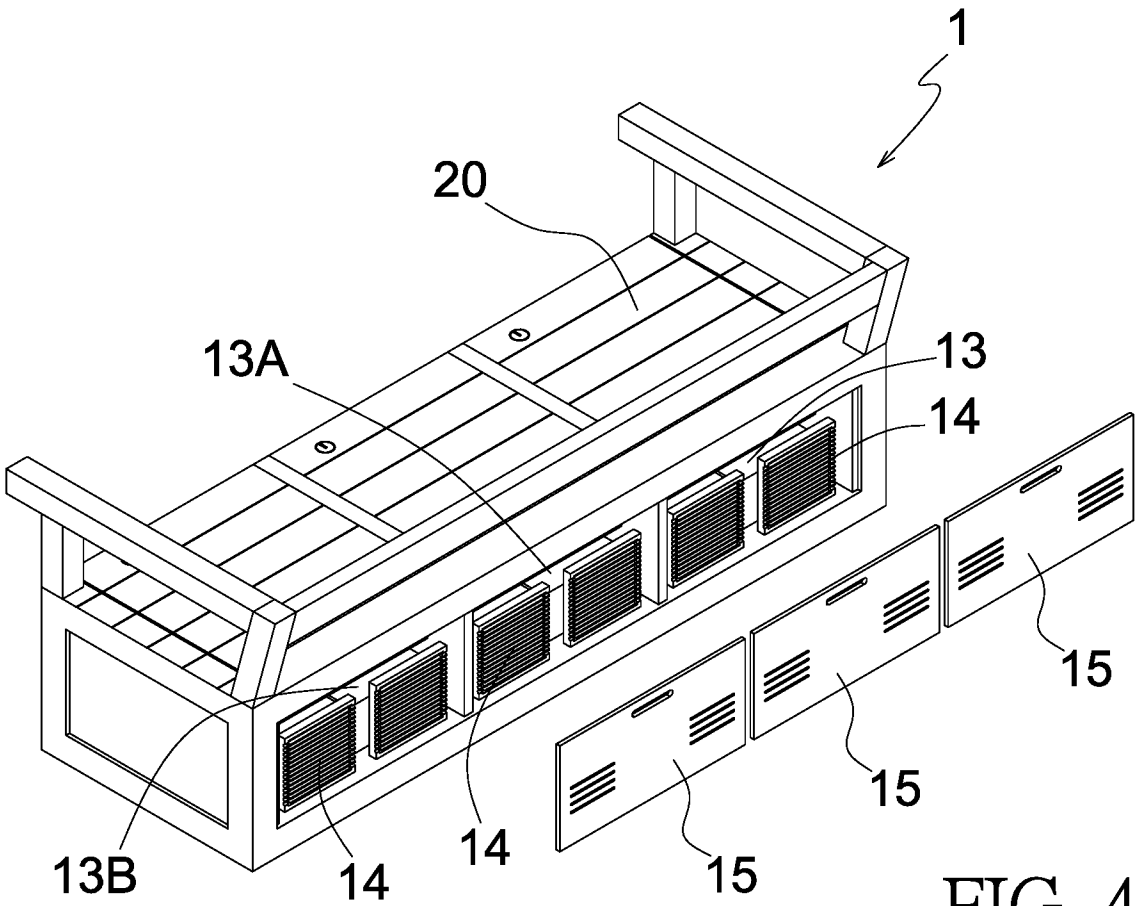
FIG. 4 is a perspective view showing the exploded components of the intelligent chair structure according to the preferred embodiment of the present invention.

With reference to FIGS. 1-4, an intelligent chair structure according to a preferred embodiment of the present invention comprises:

a function chair 1 including a base 10 arranged on a bottom of the function chair 1 and having three accommodation chambers 11 separately defined in the base 10, and the three accommodation chambers 11 are respectively comprised a first accommodation chamber 11*a*, a second accommodation chamber 11*b*, and a third accommodation chamber 11*c*, wherein each accommodation chamber 11*a*, 11*b*, 11*c* has a side holder 40 arranged on a peripheral side thereof, and the side holder 40 has a slot 41 defined on a predetermined position thereof, wherein each accommodation chamber 11*a*, 11*b*, 11*c* has a rotatable lid 20 rotatably connected on a top thereof, and the function chair 1 further includes a power switch 30 arranged thereon; wherein each accommodation chamber 11*a*, 11*b*, 11*c* has a refrigerator 13, a heat insulation apparatus 13A, and a room temperature apparatus 13B which are housed in each accommodation chamber 11*a*, 11*b*, 11*c* so as to obtain refrigeration, heat insulation, and normal temperature individually, wherein each of the refrigerator 13, the heat insulation apparatus 13A, and the room temperature apparatus 13B has a heat dissipation 14, wherein each accommodation chamber 11*a*, 11*b*, 11*c* has a radiating cover 15 corresponding to the heat dissipation 14;

a central control unit B0 mounted in the function chair 1 and supplied power from a power source P0 controlled by the power switch 30, wherein the central control unit B0 interconnects with an internet E0 and includes an application (APP) B1 built in the central control unit B0 so that a mobile device I0 is controlled remotely;

three electronic locks A0 individually accommodated in bottoms of three rotatable lids 20 of the three accommodation chambers 11*a*, 11*b*, 11*c*, wherein each of the three electronic locks A0 has a movable locking knob A2 fixed therein and corresponding to the slot 41 of the side holder 40 of each accommodation chamber 11*a*, 11*b*, 11*c*, and each electronic lock A0 has a controlling module A1 interconnected with the central control unit B0 so as to be controlled by the APP B1 of the central control unit B, such that each electronic lock A0 has the APP B1 stored therein by way of the mobile device I0 of the internet E0 so as to be remotely controlled, and the movable locking knob A2 movably enters into or separates from the slot 41, thus opening/closing the rotatable lid 20 of each accommodation chamber 11*a*, 11*b*, 11*c*; and a monitoring module C0 arranged on a predetermined position of the function chair 1, and the monitoring module C0 including a video device C1 interconnected with the central control unit B0 and controlled by the APP B1 of the central control unit B0, wherein the monitoring module C0 is remotely controlled by the APP B1 of the mobile device I0 via the internet E0 so that the monitoring module C0 sends images to the mobile device I0 or the video device C1 takes pictures or records visual images in a scene.

The function chair 1 includes a chair back 12 formed on a side thereof so that the monitoring module C0 is fixed adjacent to an upper end of the chair back 12.

The rotatable lid 20 of the function chair 1 includes a fixing orifice 43 defined on a top thereof relative to each electronic lock A0 and corresponding to a key so as to unlock/lock each electronic lock A0.

The rotatable lid 20 of the function chair 1 is rotated and includes a notch 21 formed on a front end of the rotatable lid 20.

The central control unit B0 includes a Bluetooth receiving unit T0 and a WiFi receiving unit W0 which are built in the central control unit B0 and are interconnected with the mobile device I0 so as to wirelessly control the mobile device I0.

After the mobile device I0 is interconnected with the central control unit B0 via the internet, the rotatable lid 20 of each accommodation chamber 11*a*, 11 *b*, 11*c* is opened or closed relative to each accommodation chamber 11*a*, 11*b*, 11*c* by using each electronic lock A0 so that user accommodates objects into each accommodation chamber 11*a*, 11*b*, 11*c* of the function chair 1 after opening or closing ach accommodation chamber 11*a*, 11*b*, 11*c* by using the mobile device I0, thus obtaining anti-theft. Preferably, the function chair 1 has instant monitoring in the scene by recording the visual images or taking the pictures and is remotely controlled by the user.

While various embodiments in accordance with the present invention have been shown and described, it is clear to those skilled in the art that further embodiments may be made without departing from the scope of the present invention.

What is claimed is:

1. An intelligent chair structure comprising:

a function chair including a base arranged on a bottom of the function chair and having three accommodation chambers separately defined in the base, and the three accommodation chambers are respectively comprised a first accommodation chamber, a second accommodation chamber, and a third accommodation chamber, wherein each accommodation chamber has a side holder arranged on a peripheral side thereof, and the side holder has a slot defined on a predetermined position thereof and corresponding to each accommodation chamber, wherein each accommodation chamber has a rotatable lid rotatably connected on a top thereof, and the function chair further includes a power switch arranged on a preferred position thereof; wherein each accommodation chamber has a refrigerator, a heat insulation apparatus, and a room temperature apparatus which are housed in each accommodation chamber so as to obtain refrigeration, heat insulation, and normal temperature individually, wherein each of the refrigerator, the heat insulation apparatus, and the room temperature apparatus has a heat dissipation, wherein the function chair includes a radiating cover corresponding to the heat dissipation;

a central control unit mounted in the function chair and supplied power from a power source controlled by the power switch, wherein the central control unit is interconnected with an internet and includes an application (APP) built in the central control unit so that a mobile device is controlled remotely;

three electronic locks individually accommodated in bottoms of three rotatable lids of the three accommodation chambers, wherein each of the three electronic locks includes a movable locking knob fixed therein and corresponding to the slot of the side holder of each accommodation chamber, and each electronic lock includes a controlling module interconnected with the central control unit so as to be controlled by the APP of the central control unit, such that each electronic lock has the APP stored therein by way of the mobile device of the internet so as to be remotely controlled, and the movable locking knob movably enters into or separates from the slot, thus opening/closing the rotatable lid of each accommodation chamber; and a monitoring module arranged on a predetermined position of the function chair, and the monitoring module including a video device interconnected with the central control unit and controlled by the APP of the central control unit, wherein the monitoring module is remotely controlled by the APP of the mobile device via the internet so that the monitoring module sends images to the mobile device or the video device takes pictures or records visual images in a scene.

2. The intelligent chair structure as claimed in claim 1, wherein the function chair 1 includes a chair back formed on a side thereof so that the monitoring module is fixed adjacent to an upper end of the chair back.

3. The intelligent chair structure as claimed in claim 1, wherein the rotatable lid of the function chair includes a fixing orifice defined on a top thereof relative to each electronic lock and corresponding to a key so as to unlock/lock each electronic lock.

4. The intelligent chair structure as claimed in claim 1, wherein the rotatable lid of the function chair is rotated and includes a notch formed on a front end of the rotatable lid.

5. The intelligent chair structure as claimed in claim 1, wherein the central control unit includes a Bluetooth receiving unit and a WiFi receiving unit which are built in the central control unit and are interconnected with the mobile device so as to wirelessly control the mobile device.

* * * * *